US006152726A

United States Patent [19]

Ruck et al.

[11] Patent Number: 6,152,726

[45] Date of Patent: Nov. 28, 2000

[54] BURNER FOR OPERATING A HEAT GENERATOR

[75] Inventors: Thomas Ruck, Rekingen; Hans-Peter Knöpfel, Dottikon, both of Switzerland

[73] Assignee: Asea Brown Boveri AG, Baden, Switzerland

[21] Appl. No.: 09/417,846

[22] Filed: Oct. 14, 1999

[30] Foreign Application Priority Data

Oct. 14, 1998 [EP] European Pat. Off. ..... 98811023

[51] Int. Cl.[7] ..... F23C 5/00; F23D 14/62; F23D 11/40; F23D 14/02

[52] U.S. Cl. ..... 431/284; 431/285; 431/351; 431/353; 431/349

[58] Field of Search ..... 431/8, 9, 10, 351, 431/354, 350, 353, 349, 284, 285

[56] References Cited

U.S. PATENT DOCUMENTS

| | | | |
|---|---|---|---|
| 2,365,945 | 12/1944 | Ferguson | 431/349 |
| 2,647,568 | 8/1953 | Sloan | 431/284 |
| 2,675,068 | 4/1954 | Golus et al. | 431/349 |
| 3,111,979 | 11/1963 | Peoples . | |
| 3,302,596 | 2/1967 | Zinn | 431/284 |
| 5,259,755 | 11/1993 | Irwin et al. | 431/284 |
| 5,794,449 | 8/1998 | Razdan et al. . | |
| 5,954,495 | 9/1999 | Knopfel et al. | 431/284 |
| 6,007,325 | 12/1999 | Loftus et al. | 431/284 |

FOREIGN PATENT DOCUMENTS

| | | |
|---|---|---|
| 0 589 520 | 3/1994 | European Pat. Off. . |
| 0780629 | 6/1997 | European Pat. Off. . |
| 0 797 051 | 9/1997 | European Pat. Off. . |
| 0 801 268 | 10/1997 | European Pat. Off. . |
| 2 319 846 | 2/1977 | France . |
| 96/00364 | 1/1996 | WIPO . |

*Primary Examiner*—Carl D. Price
*Attorney, Agent, or Firm*—Burns, Doane, Swecker & Mathis, L.L.P.

[57] ABSTRACT

A burner for operating a heat generator includes a rotation generator (100) for a combustion air stream (115), a device for injecting at least one fuel (112, 116) into the combustion air stream, a number of transition channels (201) for transferring a flow formed in the rotation generator into a mixing pipe (20) located downstream from these transition channels, and a pilot burner system (300) in the lower part of the mixing pipe (20), in which the pilot burner system (300) is in active connection with rotation generators (400) located at the end side of the mixing pipe (20). The interaction between the pilot burner system and rotation generators ensures maximized flame stability in the combustion chamber (30), and a general minimization of pollutant emissions, while increasing the load range for lower pollutants towards smaller loads.

16 Claims, 9 Drawing Sheets

103
116
116a
100
115
201
200
10
220
40
21
60
20
31
30

50
70

BURNER FOR OPERATING A HEAT GENERATOR

BACKGROUND OF THE INVENTION

1. Field of the Invention

The invention relates to a burner for operating a heat generator.

2. Brief Description of the Related Art

EP-0 780 629 A2 describes a burner on the incoming flow side of a rotation generator, in which the generated rotational flow is transferred seamlessly into a mixing section. This is accomplished using a flow geometry formed at the start of the mixing section for this purpose, the flow geometry including transition channels that, according to the number of tangentially acting flow-in channels or flow-in slits of the rotation generator, sectorially form the front face of the mixing section and extend rotationally in the flow direction. On the outgoing flow side from these transition channels, the remaining mixing section has a number of film formation bores through which a volume of air flows into the mixing section and which induces an increase in the flow speed along the pipe wall. This is followed by a combustor, the transition between the mixing section and the combustor being formed by a change in the cross-section, in the plane of which a flow-back zone or flow-back bubble is formed.

The intensity of the rotation in the rotation generator accordingly is chosen in such a way that the vortex does not burst inside the mixing section but further downstream as explained above, in the area of the change in the cross-section. The length of the mixing section is such that it ensures an adequate premixing quality for all types of fuels used.

Although this burner represents a leap in quality when compared with those of the previous state of the art in regard to strengthening flame stability, lower pollutant emissions, reduced pulsations, complete burnout, large operating range, good cross-ignition between the various burners, compact design, improved mixing, etc., it was found that instabilities may develop in the transient ranges and with partial loads. This is in particular related to the fact that when this burner functions together with a pilot burner system, this burner is operated in the range of about a 50% partial load near the lean extinguishing limit. In the process, the flame becomes more unstable, and extinguishing pulsations may occur, i.e., extinguishing the flame is caused by combustor oscillations. While a stabilization may be achieved with a small amount of pilot gas, this drastically increases pollutant emissions.

SUMMARY OF THE INVENTION

One object of the present invention is to remedy these deficiencies in prior burners. Burners according to the present invention ensure strengthening of flame stability for the purpose of achieving a sustained, stable operation, in particular in the transient load ranges, while realizing the additional objective of minimizing pollutant emissions from such an operation and, in this way, increasing the partial range, especially towards lower partial loads.

For this purpose, the burner is extended in such a way that in the transition area of the mixing section to the subsequent combustor a system for providing a fuel/air mixture is provided that generally functions as a pilot stage. In addition, rotation generators are provided in this area that produce so-called vortex braids on the outside of the main stream of the burner during operation.

Among the essential advantages of burners according to the invention are that the pilot burners are operated with small fuel concentration, and, in functional connection with the rotation generators, better mixing of the burner fuel with the surrounding hot gas reaches a stability of the premix combustion close to that of the lean extinguishing limit. If the fuel of the pilot burner is injected into the vortex braids generated by the rotation generators, this significantly improves the mixing and greatly reduces pollutant emissions. Accordingly, an extension towards small loads is achieved with an expansion of the load range and with low pollutant emissions.

According to a first exemplary embodiment, a burner useful for operating a heat generator comprises an upstream rotation generator capable of rotating a combustion air stream, the upstream rotation generator having an upstream end and a downstream end, means for injecting at least one fuel into the combustion air stream from the upstream rotation generator, a mixing section downstream from the upstream rotation generator having a downstream end, at least one transition channel for transferring downstream a flow formed in the upstream rotation generator, and a mixing pipe downstream from the transition channels and receiving the flow from the transition channels, the mixing pipe having a bottom part, a downstream end side, and a center axis, at least one rotation generator on the mixing pipe end side capable of forming a flow swirl, and a pilot burner system in the mixing pipe bottom part actively connected to the at least one rotation generator.

Still other objects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to preferred embodiments of the apparatus and method, given only by way of example, and with reference to the accompanying drawings, in which.

DESCRIPTION OF THE PREFERRED EMBODIMENTS

Figures 1, 8, 9, 10, 11, 12:
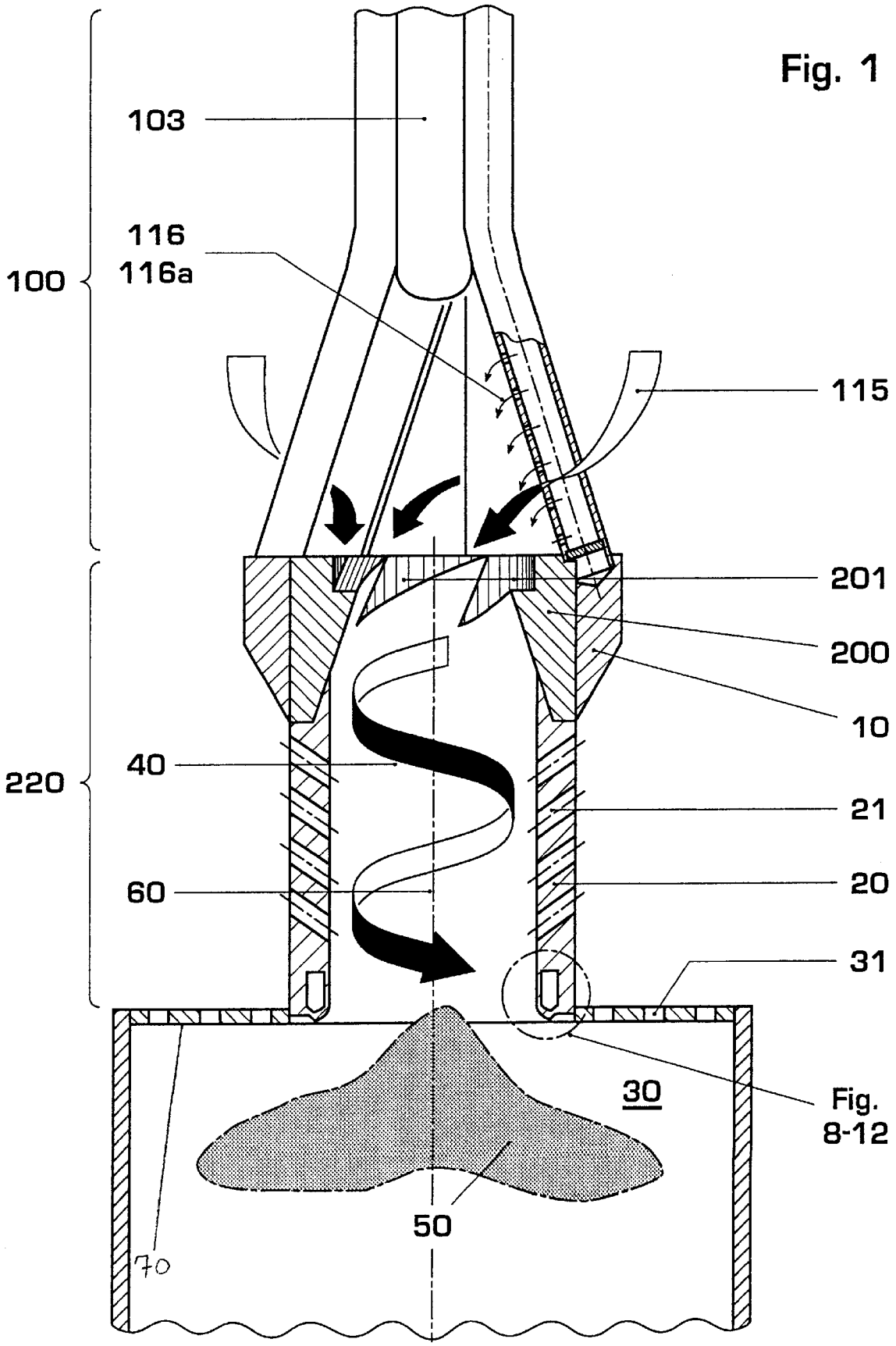
FIG. 1 illustrates a burner designed as a premix burner with a mixing section downstream from a rotation generator, along with a schematic drawing of a pilot fuel channel in the area of a tear-off edge.
FIG. 8 illustrates a tear-off edge for spatial stabilization of the backflow zone.
FIG. 9 schematically illustrates a design of the mixing section at its downstream end, and of the rotation generators constructed there.
FIG. 10 illustrates a perspective view of the rotation generator configuration.
FIG. 11 illustrates a cross-sectional view of the rotation generator of FIG. 10.
FIG. 12 illustrates another perspective view of the rotation generator of FIG. 10.

Exemplary embodiments of the invention are explained in more detail below in reference to the drawings. All features not necessary for a direct understanding of the invention have been left out. Identical elements have been designated with the same reference characters throughout the different figures. The flow direction of the media is indicated by arrows, from upstream to downstream.

FIG. 1 shows the overall construction of a burner. A rotation generator 100, the design of which is shown and explained in more detail in FIGS. 3–6, is activated on the head side of this burner. Rotation generator 100 is a conical structure which is impacted repeatedly by a tangentially inflowing combustion air stream 115. The flow resulting from this is seamlessly fed with the help of a transition geometry 200 located downstream from the rotation generator 100 into a mixing section in such a way that no separation areas can occur there. The configuration of this transition geometry 200 is described in more detail below with reference to FIG. 6.

Mixing section 220 itself includes transition piece 200 and is extended downstream from the transition piece with a mixing pipe 20. Naturally, the mixing section 220 may be constructed as a single piece, in which case transition piece 200 and mixing pipe 20 form a single, continuous structure, in which the characteristics of each part are preserved. If the transition piece 200 and the mixing pipe 20 are constructed from two parts, thy are preferably connected with a bushing ring 10, which bushing ring 10 serves on the head side as a structural anchoring surface for the rotation generator 100. Such a bushing ring 10 also has the advantage that different mixing pipes can be used. On the outflow or downstream side of the mixing pipe 20, the actual combustion chamber 30 of a combustor, which in this case is only symbolized by a flame pipe, is located.

The mixing section 220 essentially has the function of providing a defined section downstream from the rotation generator 100, in which perfect premixing of fuels of various types can be achieved. In this mixing section 220, i.e., inside the mixing pipe 20 and in active connection with the transition piece 200 located upstream, a loss-free flow forms, so that initially no backflow zone or backflow bubble is able to form, so that the mixing quality of the injected fuels can be influenced over the entire length of the mixing section 220. However, mixing section 220 also has another characteristic, namely that the axial speed profile has a distinct maximum on the axis in this mixing section itself, so that flashback of the flame from the combustor into the burner itself is not possible. It is also correct, however, that with such a configuration the axial speed decreases towards the wall. In order to also prevent flashback in this area, the mixing pipe 20 is provided in the flow and peripheral direction with a number of regularly or irregularly distributed bores 21 that have different cross-sections and directions, through which bores a quantity of air flows into the inside of the mixing pipe 20 and induces an increase in the flow speed along the wall, in the sense of forming a film. Furthermore, bores 21 also can be designed so that at least effusion cooling occurs at the inside wall of the mixing pipe 20. Alternatively or in addition, another possibility for increasing the speed of the mixture within the mixing tube 20 is by constricting the latter's flow cross-section downstream from the transition channels 201 that are part of the transition piece 200 and form the already mentioned transition geometry, so that the entire speed level inside the mixing pipe 20 is increased.

In FIG. 1, bores 21, through which the air flows, extend at an acute angle to the burner axis 60. The outlet of the transition channels 201 furthermore corresponds to the narrowest flow cross-section of the mixing pipe 20. Transition channels 201 therefore bridge the respective cross-section differential in the flow direction without adversely affecting the formed flow. If there is an unacceptable loss of pressure when the pipe flow 40 is guided along the mixing pipe 20, this can be addressed or remedied by providing a diffuser or Venturi element (not illustrated) at the end of the mixing pipe 20. The end of the mixing pipe 20 is therefore followed by a combustor 30 (combustion chamber), in which a change in cross-section caused by a burner front 70 exists between the two flow cross-sections of the mixing pipe and combustor. It is only here that a central flame front with a flowback zone 50, that has the characteristics of a bodiless flame retention baffle in relation to the flame front, is formed. If, during operation, a marginal flow zone forms within this cross-section change, in which turbulence separations are created because of the vacuum present there, there results an increased ring stabilization of the flowback zone 50.

In addition, it must not go unmentioned, that the formation of a stable flowback zone 50 also requires a sufficiently high rotation value in a pipe. If such a rotation value is initially undesired, stable flowback zones can be created by introducing small air flows with strong rotations at the pipe end, for example through tangential openings. In the process it is hereby assumed that the air quantity required for this is about 5 to 20% of the total air quantity. In regard to the design of the burner front 70 at the end of the mixing pipe 20 for stabilizing the backflow zone or backflow bubble 50 as well as the flame front, reference is made to the description for FIGS. 8–12.

Figure 2:
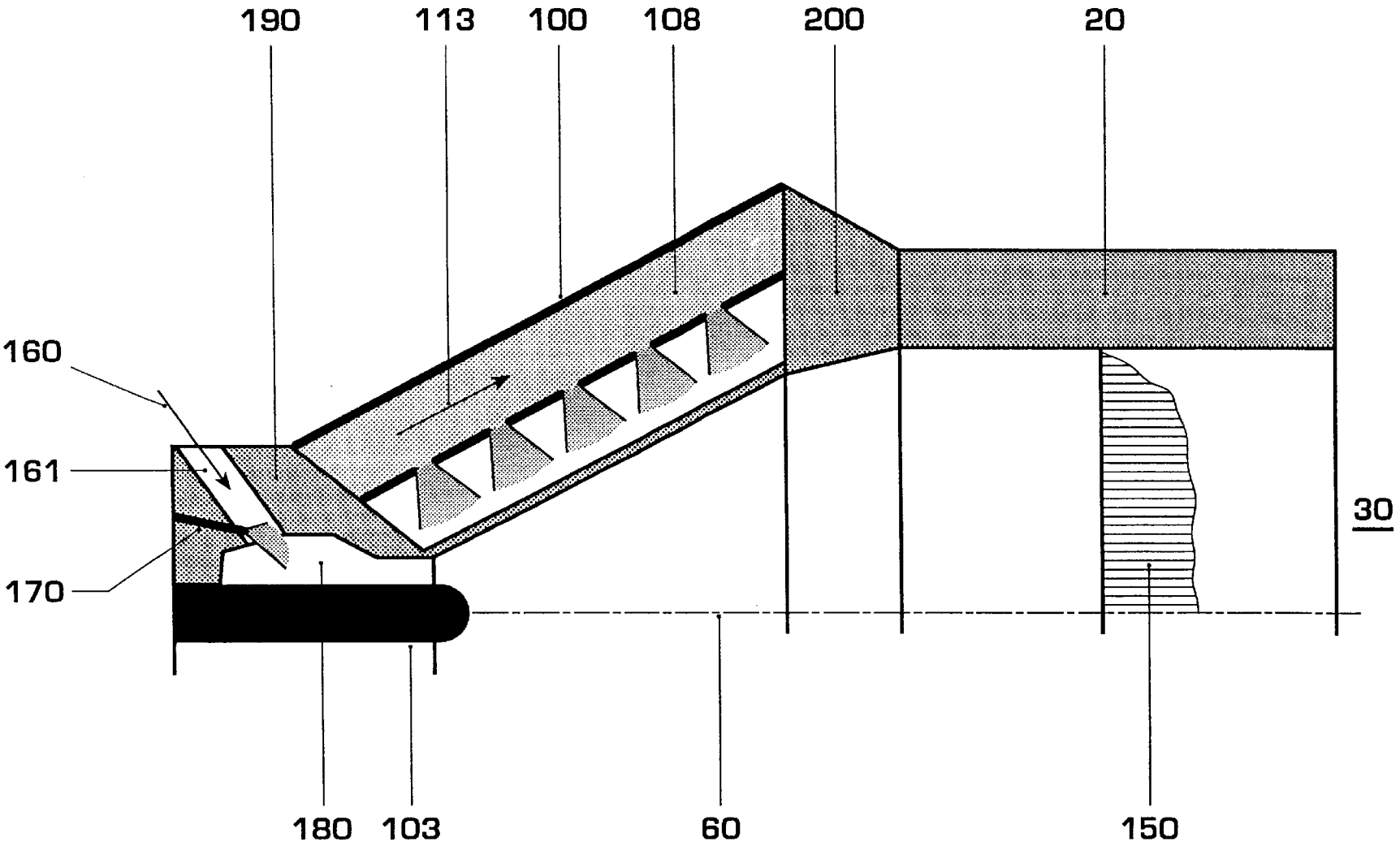
FIG. 2 schematically illustrates the burner according to FIG. 1, with additional fuel injectors arranged on the head side.

FIG. 2 schematically illustrates a view of the burner according to FIG. 1, whereby here reference is made specifically to the flow around a centrally located fuel nozzle 103 and to the action of fuel injectors 170. The function of the remaining main components of the burner, i.e., rotation generator 100 and transition piece 200, are described in more detail below in reference to the following figures. The fuel nozzle 103 is enclosed at a distance with a ring 190 into which a number of peripherally disposed bores 161 have been integrated, through which an air quantity 160 flows into an annular chamber 180, and there flows around the fuel lance or nozzle 103. These bores 161 are placed so as to angle forward in such a way as to create an appropriate axial component on the burner axis 60. In active connection with these bores 161, additional fuel injectors 170 are provided which add a certain quantity of a preferably gaseous fuel into the respective air quantity 160, so that a uniform fuel concentration 150 appears over the flow cross-section in the mixing pipe 20, as is symbolized in FIG. 2. Exactly this uniform fuel concentration 150, in particular the strong concentration on the burner axis 60, ensures that a stabilization of the flame front occurs at the outlet of the burner, preventing any occurrence of combustor pulsations.

Figure 3:
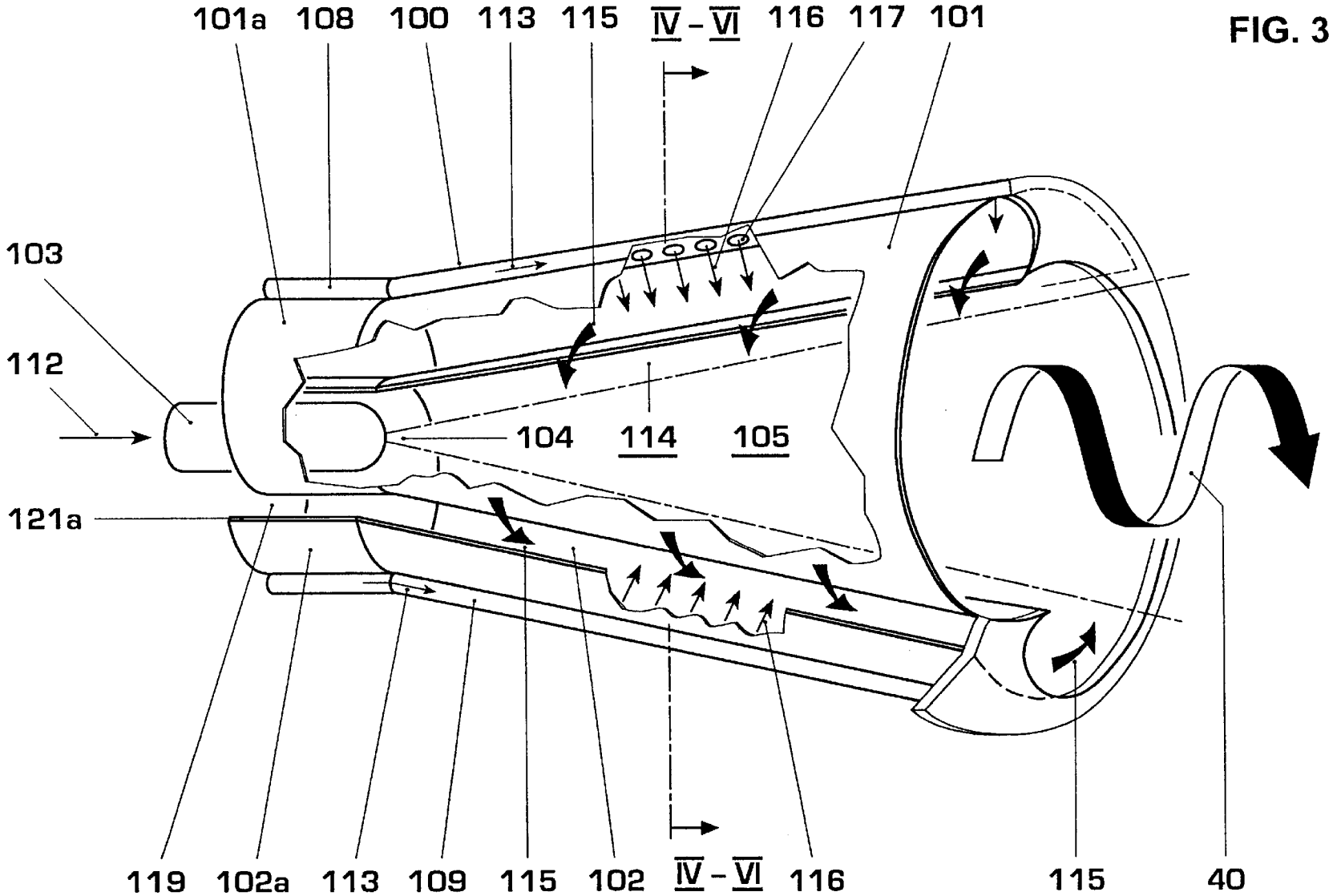
FIG. 3 illustrates a perspective drawing of a rotation generator including several segments, sectioned accordingly.
Figure 4:
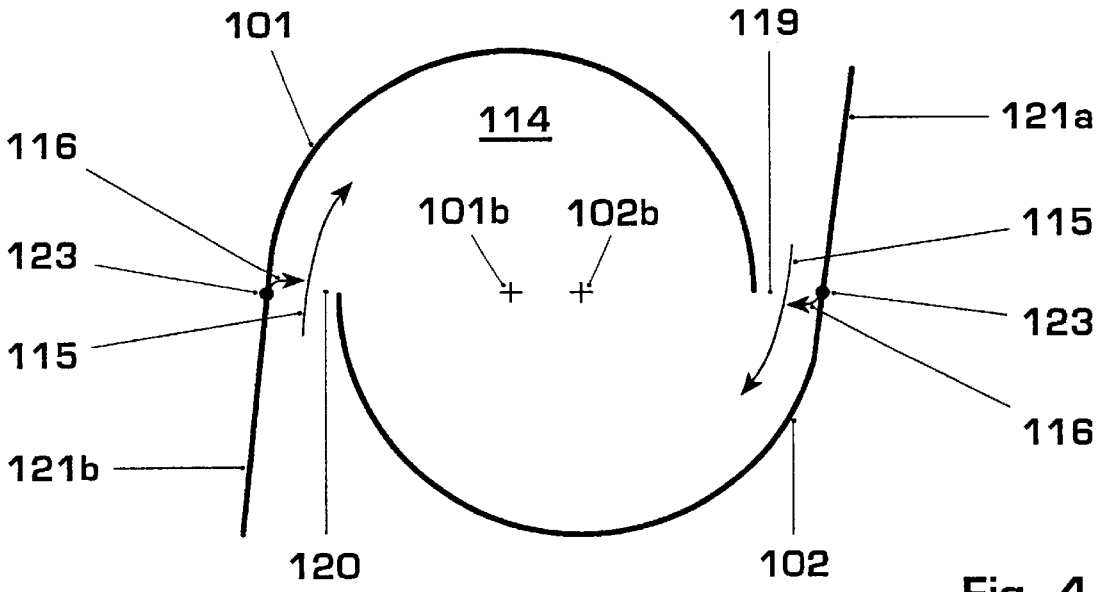
FIG. 4 illustrates a cross-section through a two-segment rotation generator.

In order to better comprehend the construction of the rotation generator 100, it is advantageous to explain FIG. 3 at least in conjunction with FIG. 4. If needed, the following text therefore will refer to the other figures when describing FIG. 3.

Figure 5:
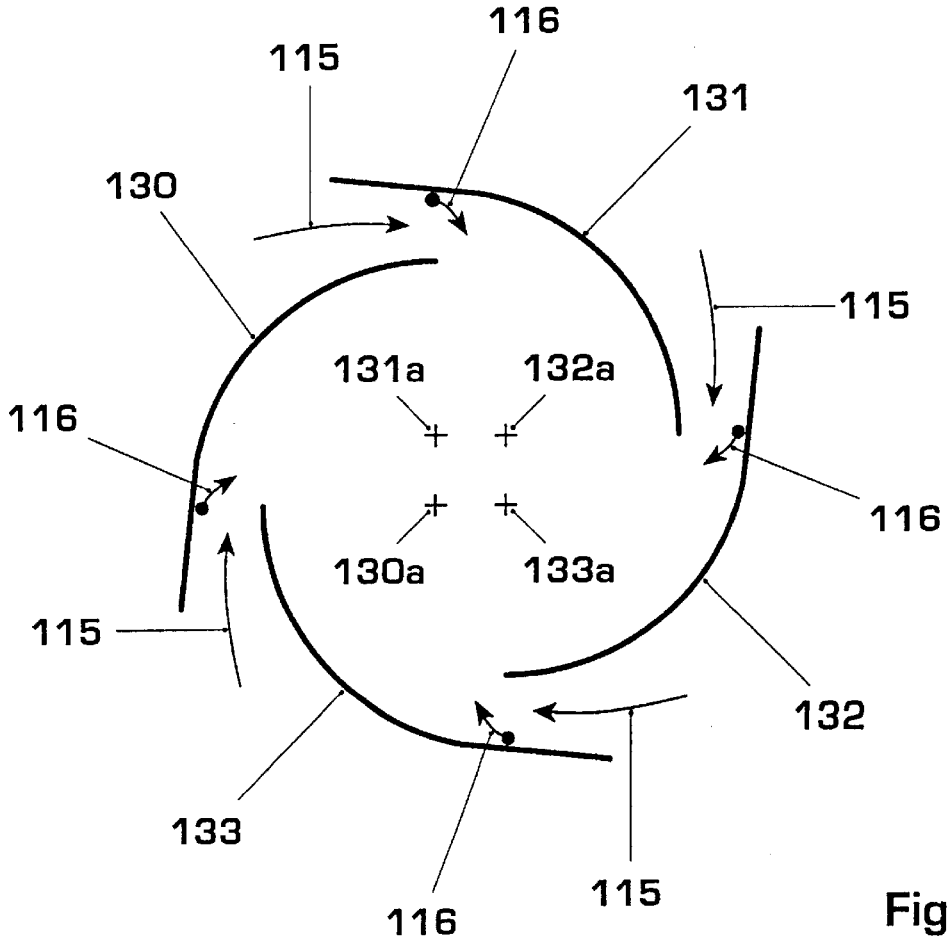
FIG. 5 illustrates a cross-section through a four-segment rotation generator.
Figure 6:
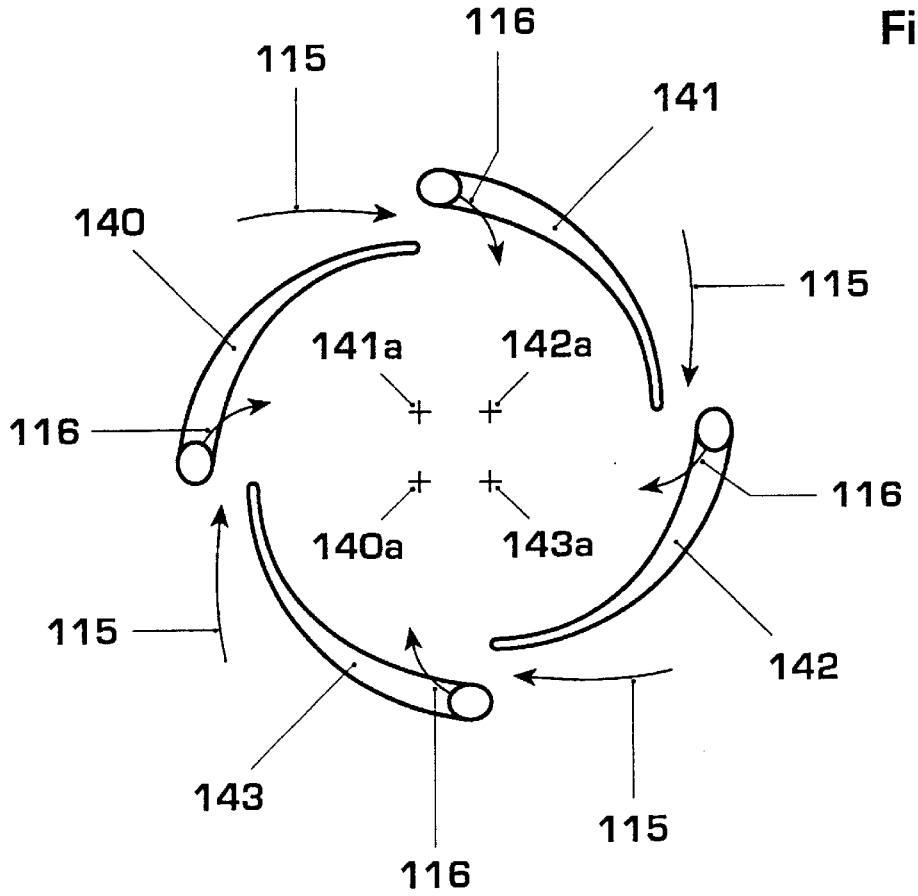
FIG. 6 illustrates a view through a rotation generator whose segments are profiled in blade-shape.

The first part of the burner according to FIG. 1 forms the rotation generator 100 in FIG. 3. The latter includes two hollow, conical partial bodies 101, 102 which are stacked offset inside each other. The number of conical partial bodies naturally may be greater than two, as can be seen in FIGS. 5 and 6; as will also be explained further below, this depends in each case on the overall operating mode of the burner. In certain operating configurations it is possible that a rotation generator include only a single spiral. The placement of the respective center axis or longitudinal symmetry axes 101*b*, 102*b* (see FIG. 4) of the conical partial bodies 101, 102 relative to each other creates in the adjoining wall, in a mirror-symmetrical arrangement, a tangential channel, i.e., an air inlet slit 119, 120 (see FIG. 4) through which the combustion air 115 flows into the interior of the rotation generator 100, i.e., into the conical cavity 114. The conical shape of the shown partial bodies 101, 102 in the flow direction has a specific fixed angle. Naturally, depending on the specific operating case, the partial bodies 101, 102 may have an increasing or decreasing conical angle in the flow direction, similar to a trumpet or, respectively, a tulip. The two last mentioned forms are not shown in the drawing since the routineer in the art will readily and easily be able to understand them.

The two conical partial bodies 101, 102 each have a cylindrical, annular starting part 101*a*. The fuel nozzle 103, already mentioned in reference to FIG. 2 and which is preferably operated with a liquid fuel 112, is located in the area of this cylindrical starting part. The injection 104 of this fuel 112 coincides approximately with the narrowest cross-section of the conical cavity 114 formed by the conical partial bodies 101, 102. The injection capacity and the type of this fuel nozzle 103 depend on the specified parameters of the respective burner. The conical partial bodies 101, 102 also each have a fuel line 108, 109 which are located along the tangential air inlet slits 119, 120 and are provided with injection openings 117 through which preferably a gaseous fuel 113 is injected into the combustion air 115 flowing there, as is indicated symbolically by arrows 116. These fuel lines 108, 109 are arranged preferably at the end of the tangential inflow, prior to the entrance into the conical cavity 114, in order to obtain an optimum air/fuel mixture. The fuel 112 supplied through the fuel nozzle 103 is, as mentioned, usually a liquid fuel, which can be easily mixed with another medium, for example, with recycled flue gas. This fuel 112 is injected at a preferably very acute angle into the conical cavity 114. This means that after the fuel nozzle 103 a conical fuel spray 105 forms, which is enclosed and reduced by the tangentially inflowing, rotational combustion air 115. The concentration of the injected fuel 112 is then constantly reduced in axial direction by the inflowing combustion air 115, resulting in a mixing that approaches an evaporation. If a gaseous fuel 113 is added via the opening nozzles 117, the fuel/air mixture is formed directly at the end of the air inlet slits 119, 120. If the combustion air 115 is additionally preheated or enriched, for example with recycled flue gas or exhaust gas, this greatly supports the evaporation of the liquid fuel 112, before this mixture flows into the next stage, here into the transition piece 200 (see FIGS. 1 and 7). The same concepts also apply if liquid fuels are supplied via lines 108, 109. When designing the conical partial bodies 101, 102 in regard to the conical angle and the width of the tangential air inlet slits 119, 120, narrow limits must actually be kept, so that the desired flow field of the combustion air 115 is able to form at the outlet of the rotation generator 100. In general, it can be said that a reduction of the tangential air inlet slits 119, 120 promotes faster formation of a backflow zone already in the area of the rotation generator.

The axial speed within the rotation generator 100 can be increased or stabilized with an addition of an air quantity 160 that is described in more detail in reference to FIG. 2. A corresponding rotation generation in active connection with the subsequent transition piece 200 (FIGS. 1 and 7) prevents the formation of flow separations in the mixing pipe following the rotation generator 100. The construction of the rotation generator 100 is also very suitable for changing the size of the tangential air inlet slits 119, 120, so that a relatively large operating bandwidth can be covered without changing the design length of the rotation generator 100. The partial bodies 101, 102 naturally can also be moved relative to each other on a different plane, whereby even an overlapping of them is possible. It is also possible to stack the partial bodies 101, 102 spiral-like inside each other by a counter-rotating movement. This makes it possible to change the shape, size, and configuration of the tangential air inlet slits 119, 120 as desired, so that the rotation generator 100 can be universally used without changing its design length.

FIG. 4, among other things, shows the geometric configuration of optionally provided baffle plates 121*a*, 121*b*. They have a flow introduction function and, depending on their length, extend the respective ends of the conical partial bodies 101, 102 in the flow direction relative to the combustion air 115. Channeling of the combustion air 115 into the conical cavity 114 can be optimized by opening or closing the baffle plates 121*a*, 121*b* around a pivoting point 123 located in the area of the entrance of this channel into the conical cavity 114; this is in particular necessary if the original slit size of the tangential air inlet slits 119, 120 should be changed dynamically, for example in order to change the speed of the combustion air 115. Naturally, these dynamic measures can also be provided statically, in that baffle plates, as required, form a fixed part with the conical partial bodies 101, 102.

Compared to FIG. 4, FIG. 5 shows that the rotation generator 100 can alternatively be constructed of four partial bodies 130, 131, 132, 133. The associated longitudinal symmetry axes for each partial body are designated with the letter "a". Regarding this configuration, it should be mentioned that, as a result of the lower rotation intensity generated with it and in connection with a correspondingly greater slit width, it is ideally suited to prevent the bursting of the turbulence flow downstream from the rotation generator in the mixing pipe, so that the mixing pipe is able to optimally fulfill its intended role.

Compared to FIG. 5, the difference in FIG. 6 is that here the partial bodies 140, 141, 142, 143 have a blade profile shape which has been provided to provide a certain flow. Other than that, the operating mode of the rotation generator has remained the same as with the embodiment illustrated in FIG. 5. The admixture of the fuel 116 into the combustion air stream 115 is accomplished from the inside of the blade profiles, i.e., the fuel line 108 is now integrated into the individual blades. The longitudinal symmetry axes for the individual partial bodies are also designated with the letter "a".

Figure 7:
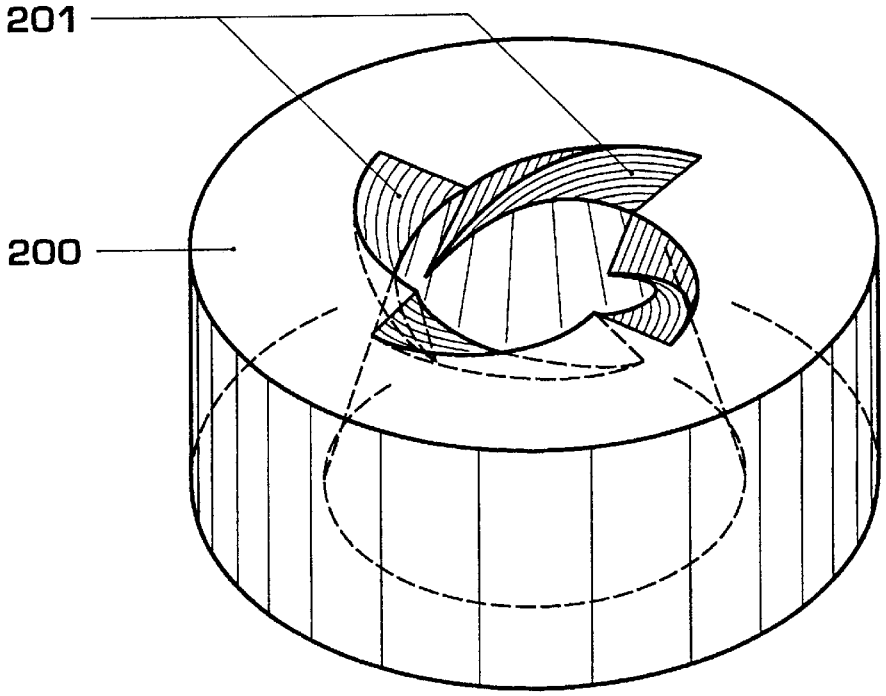
FIG. 7 illustrates a variation of the transition geometry between rotation generator and mixing section.
Figure 8:
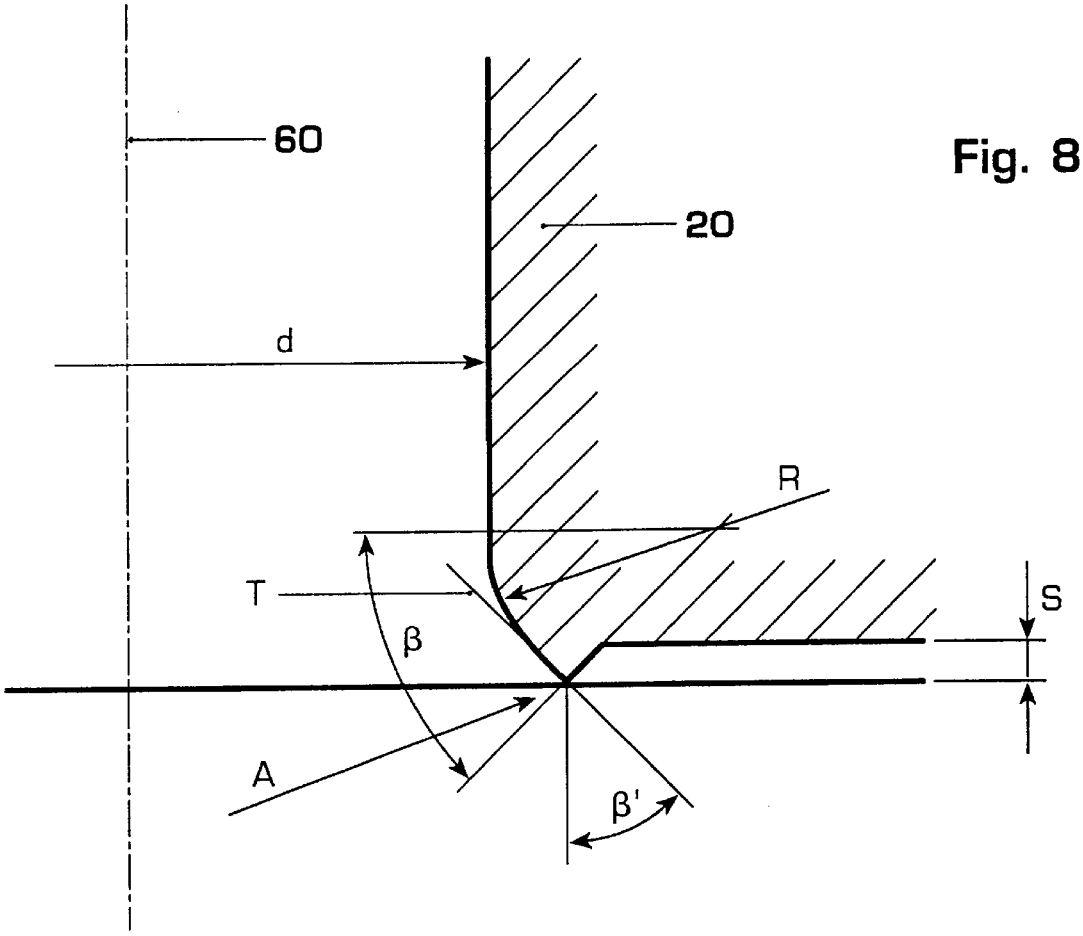
Figure 9:
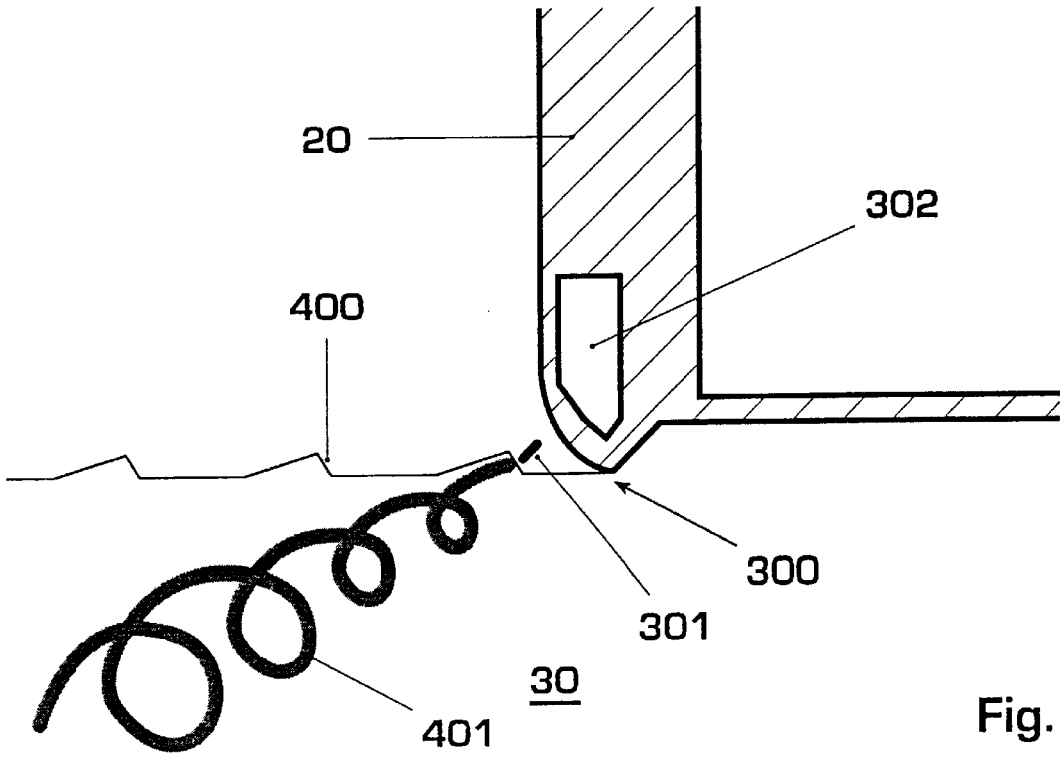
Figure 10:
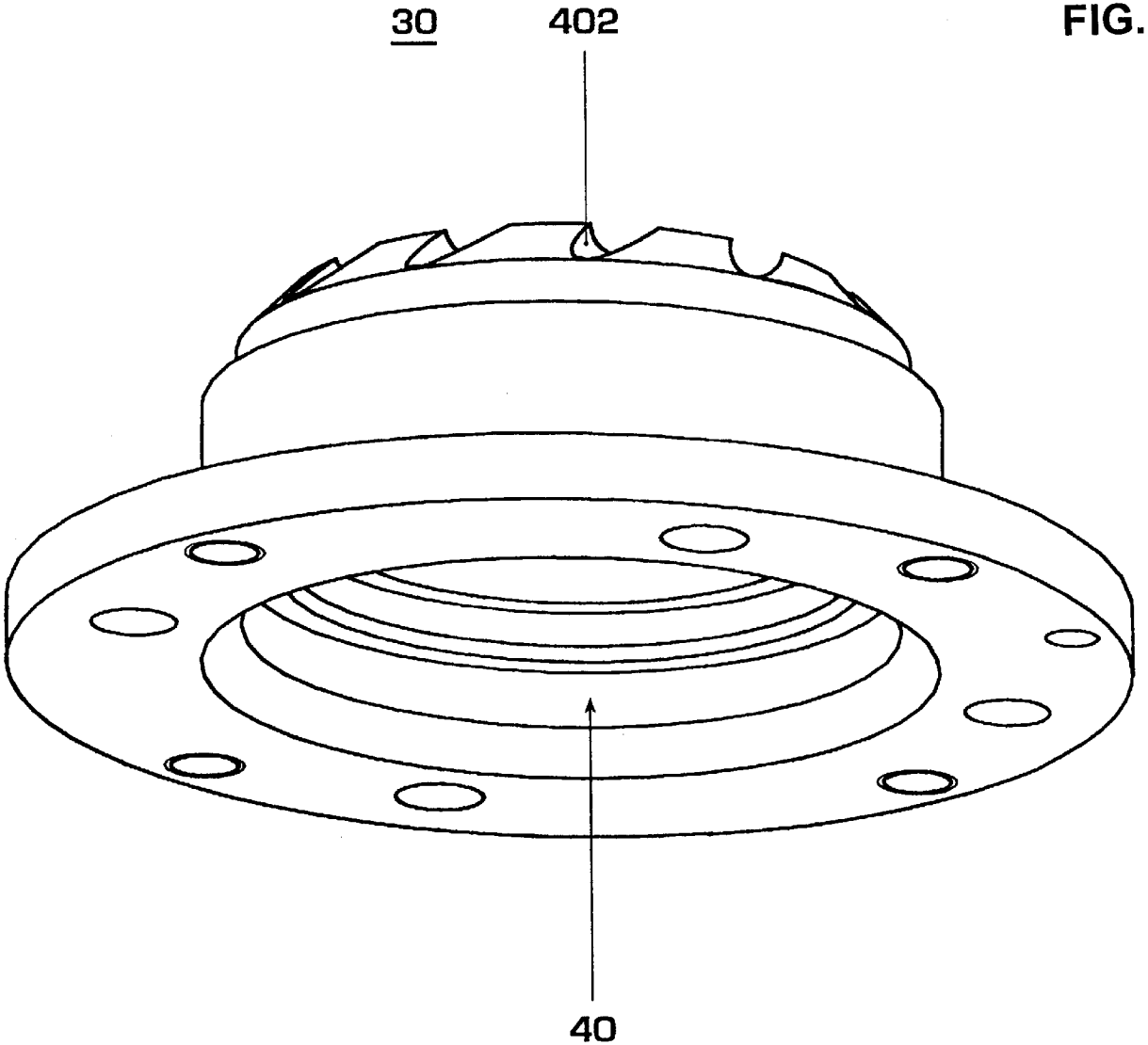
Figure 11:
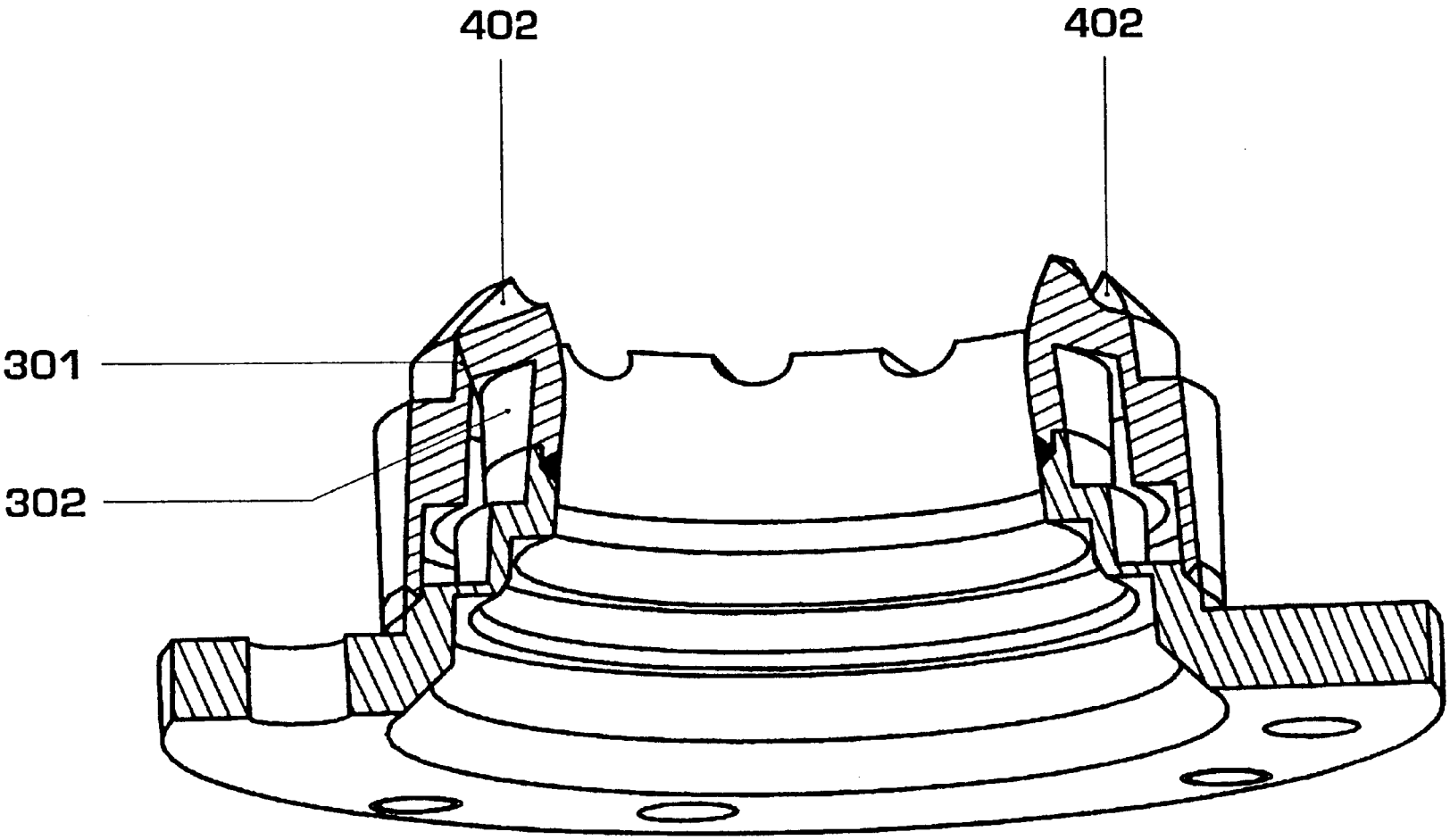
Figure 12:
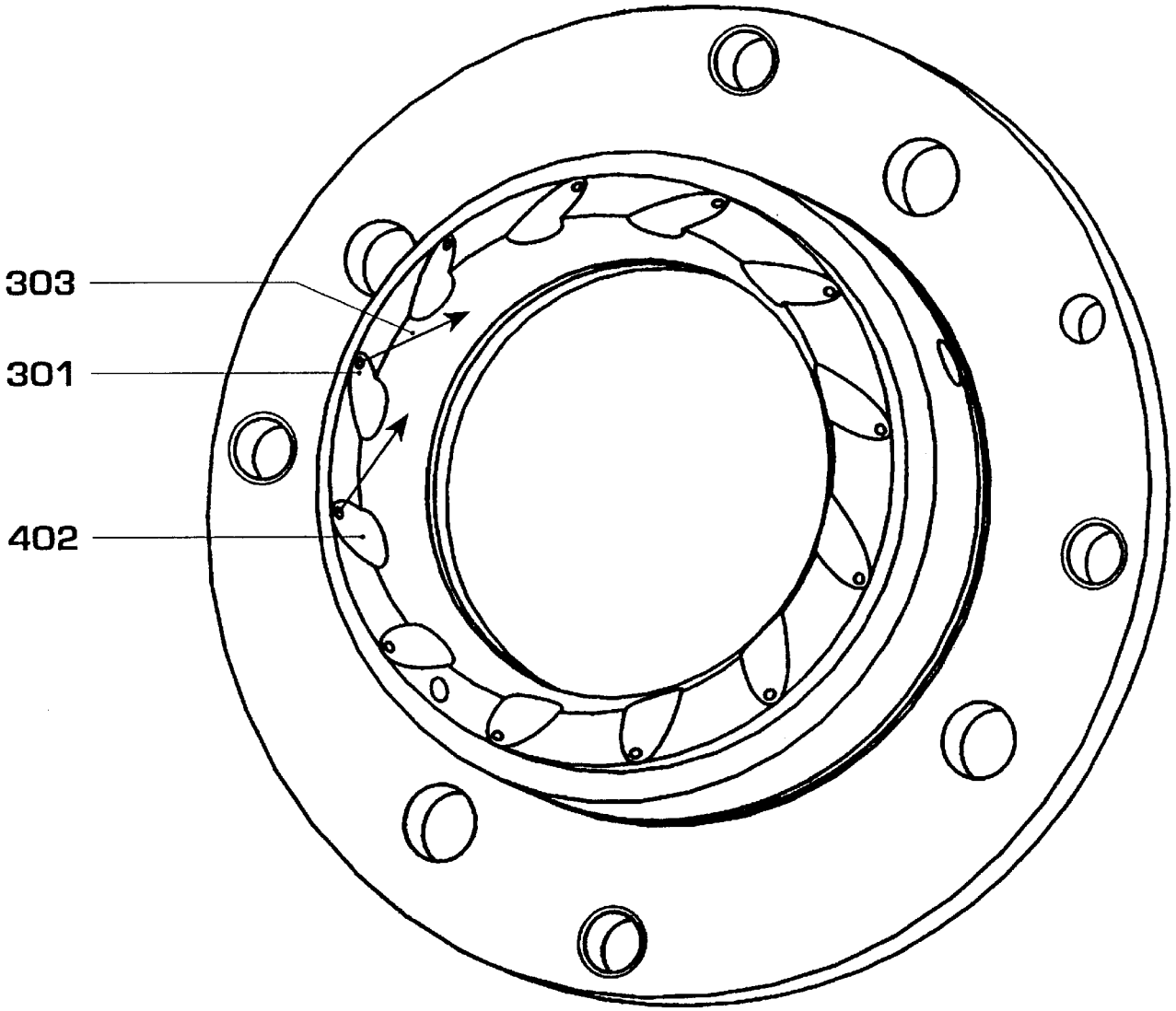

FIG. 7 shows a three-dimensional view of the transition piece 200. The transition geometry is constructed for a rotation generator 100 with four partial bodies, corresponding to FIG. 5 or 6. Accordingly, the transition geometry has four transition channels 201 as a natural extension of the partial bodies acting upstream, so that the conical quarter surface of said partial bodies is extended until it intersects the wall of the mixing pipe. The same concepts also apply if the rotation generator has been constructed according to a different principle than the one described in reference to FIG. 3. The surface of the individual transition channels 201 that extends downward in the flow direction has a spiral shape in the flow direction that describes a sickle-shaped progression, corresponding to the fact that the flow cross-section of the transition piece 200 is conically extended in the flow direction. The rotation angle of the transition channels 201 in the flow direction has been chosen so that the pipe flow then has a sufficiently long section available before the change in the cross-section at the combustor inlet to achieve perfect premixing with the injected fuel. The aforementioned measures furthermore increase the axial speed at the mixing pipe wall downstream from the rotation generator. The transition geometry and the elements in the area of the mixing pipe bring about a clear increase in the axial speed profile towards the center of the mixing pipe, decisively counteracting the risk of premature ignition.

FIG. 8 illustrates the tear-off edge (discussed above) formed at the burner outlet; the pilot burners are shown in more detail in FIGS. 9–12. The flow cross-section of the pipe 20 in this area has a transition radius R whose size depends principally on the flow inside the pipe 20. This radius R is selected so that the flow closely follows the wall and in this way causes the rotation value to greatly increase. Quantitatively, the size of the radius R can be defined so that it is greater than 10% of the inside diameter d of the pipe 20. Compared to the flow without a radius, the flowback bubble 50 formed with radius R increases enormously. This radius R extends up to the outlet plane of the pipe 20, whereby the angle β between beginning and end of the curvature is less than 90°. The tear-off edge A extends along one leg of the angle β into the interior of the pipe 20 and in this way forms a tear-off stage S relative to the front point of the tear-off edge A whose depth is greater than 3 mm. Naturally, the edge which here extends parallel to the outlet plane of the pipe 20 can now be returned to the stage of the outlet plane with a curved progression. The angle β' between the tangent of the tear-off edge A and the vertical to the exit plane of the pipe 20 is identical to the angle β. Advantages of this design of the tear-off edge are described in EP-0 780 629 A2 in the section "Description of the Invention", which is incorporated in its entirety herein by reference. A further design of the tear-off edge for the same purpose can be achieved with torus-like notches on the combustor side. EP-0 780 629 A2, including its protected scope in regard to the tear-off edge, forms an integral part of this specification.

FIG. 9 schematically illustrates a view of a pilot burner system 300 and a configuration of rotation generators 400 in active connection with the pilot burner system. A chamber 302, shown in FIG. 9, extends in the shape of a ring inside the corresponding section of the mixing pipe 20. The injection of a fuel into the hot gasses is accomplished by way of a number of nozzles 301 from chamber 302 distributed around the combustion chamber 30. This injection is in active connection with the individual, peripherally distributed rotation generators or, respectively, with the vortex braids 401 formed by them. The design of both the pilot burner system 300 and of the rotation generators 400 is described in more detail in FIGS. 10–12.

FIG. 10 illustrates a complete perspective view of the end side part of the mixing pipe 20, in which the pilot burner system and the rotation generators are located, whereby the design of this part permits an application, as is suggested, for example, by the attachment bores. On the end and combustion chamber sides of this part, a number of cut-outs 402 peripherally distributed inside the tear-off edge (FIG. 8) are provided and act as rotation generators in conjunction with the gas flow inside the mixing pipe. In terms of size, number in peripheral direction, and orientation, these cut-outs are designed differently, depending on the desired size, intensity, and orientation of the vortex braids 401 (see FIG. 9), in order to achieve the desired objective. The injection of the fuel into the vortex braids, that have been suitably designed in respect to quality, significantly improves the mixing and substantially reduces pollutant emissions. In addition, the flame front and backflow zone (FIG. 1) forming in the area of the rotation generators 402 are greatly stabilized by this injection of the fuel, together with the vortex braids 401 forming there, as well as in active connection with the tear-off edge (FIG. 8), whereby this stabilization approaches the lean extinguishing limit. The design of the rotation generators is not limited to the embodiment shown here. Instead of cut-outs, the desired swirling also can be achieved by applying suitable shapes in the end area of the mixing pipe.

FIGS. 11 and 12 show various views of the cut-outs 402 acting as rotation generators. The cut-outs shown here extend with an increasing cut-out depth along the rear of the tear-off edge and form a track having approximately the shape of half of a truncated cone. The orientation of this track extends at an angle which can vary between being purely oblique to being oblique and radial relative to the center axis of the mixing pipe, as can be seen from FIG. 12. The exact orientation selected for these cut-outs depends on the quality of the vortex braids to be formed. The direction 303 of the fuel injection through the nozzles 301 depends on the piloting effect to be achieved; this fuel injection is preferably kept tangential relative to the main flow in the mixing pipe, as is seen in FIG. 12, whereby the degree of the tangential fuel injection is designed on a case by case basis. The pilot burner system 300 can be supplied with fuel via an internal supply line through the mixing pipe, or by feeding fuel from outside into the chamber 302.

While the invention has been described in detail with reference to preferred embodiments thereof, it will be apparent to one skilled in the art that various changes can be made, and equivalents employed, without departing from the scope of the invention.

What is claimed is:

1. A burner useful for operating a heat generator comprising:

a first upstream rotation generator capable of rotating a combustion air stream, the upstream rotation generator having an upstream end and a downstream end;

means for injecting at least one fuel into the combustion air stream from the upstream rotation generator;

a mixing section downstream from the upstream rotation generator having a downstream end, at least one transition channel for transferring downstream a flow of combustion air and fuel formed in the upstream rotation generator, and a mixing pipe downstream from said at least one transition channel and receiving said flow from said at least one transition channel, the mixing pipe having an upstream part, a downstream part, a downstream end side, and a center axis;

at least one second rotation generator on the downstream end side of the mixing pipe capable of forming a swirl; and a pilot burner system in the mixing pipe downstream part, the pilot burner system being positioned so that a fuel can be injected from the pilot burner system into the swirl formed by said at least one second rotation generator.

2. A burner according to claim 1, wherein the pilot burner system is positioned so that a fuel can be injected from the pilot burner system into the swirl formed by the at least one second rotation generator.

3. A burner according to claim 2, wherein the mixing pipe defines a main flow direction, and wherein the pilot burner system is positioned so that a fuel can be tangentially injected from the pilot burner system relative to the main flow in the mixing pipe.

4. A burner according to claim 1, wherein the at least one second rotation generator comprises a plurality of cut-outs located on the mixing pipe end side.

5. A burner according to claim 4, wherein the cut-outs extend in a direction between being a direction purely oblique to being oblique and radial relative to the center axis of the mixing pipe.

6. A burner according to claim 1, wherein the mixing pipe downstream end side comprises a burner front including a tear-off edge facing downstream.

7. A burner according to claim 1, wherein the first upstream rotation generator forms a plurality of partial flows when air flows through the first upstream rotation generator, and the number of the at least one transition channel is the same as the number of partial flows created by the upstream rotation generator.

8. A burner according to claim 1, wherein the mixing pipe comprises openings extending into the mixing pipe in downstream and peripheral directions for injecting an air stream into the interior of the mixing pipe.

9. A burner according to claim 8, wherein the mixing pipe openings extend at an acute angle relative to the mixing pipe center axis.

10. A burner according to claim 1, further comprising:

a combustor downstream from the mixing section, the combustor having a flow cross-section;

the mixing section having a flow cross-section different from the combustor flow cross-section, the difference in flow cross-sections inducing an initial flow through the combustor; and wherein the difference in flow cross-section between the mixing section and the combustor allows a backflow zone is be able to act adjacent to the mixing section downstream end.

11. A burner according to claim 1, further comprising an element upstream from the combustor selected from the group consisting of a diffuser and a Venturi.

12. A burner according to claim 1, wherein the first upstream rotation generator comprises at least two hollow, conical partial bodies that are stacked inside each other in the direction of flow, each partial body having a longitudinal axis of symmetry, the respective longitudinal axes of symmetry being laterally offset from each other in such a way that adjoining walls of the partial bodies form longitudinally extending, tangential channels for a combustion air stream, the partial bodies together forming an interior chamber, and further comprising at least one fuel nozzle positioned to operate in the interior chamber.

13. A burner according to claim 12, further comprising additional fuel injectors adjacent to and along the tangential channels.

14. A burner according to claim 13, wherein the partial bodies each have a blade-shaped cross-section profile.

15. A Burner according to claim 13, wherein the partial bodies each define a conical angle in the downstream direction, the partial bodies' conical angles being selected from the group consisting of a fixed angle, an increasing angle conical, or a decreasing angle.

16. A burner according to claim 13, wherein the partial bodies are stacked spiral-like inside each other.

* * * * *